US005743500A

United States Patent [19]

Northway et al.

[11] Patent Number: 5,743,500

[45] Date of Patent: Apr. 28, 1998

[54] METHOD AND APPARATUS FOR HOLDING BOTTLES

[76] Inventors: Donald L. Northway; Margaret Northway, both of P.O. Box 292, Genoa, Nev. 89411

[21] Appl. No.: 755,574

[22] Filed: Nov. 27, 1996

[51] Int. Cl.[6] ..... A47G 23/02

[52] U.S. Cl. ..... 248/146; 248/205.2; 211/38

[58] Field of Search ..... 248/152, 146, 248/205.2, 205.1, 310, 314, 346.2, 910, 311.2, 102; 211/38

[56] References Cited

U.S. PATENT DOCUMENTS

| | | | |
|---|---|---|---|
| 2,140,231 | 12/1938 | Jefferis | 215/12 |
| 2,264,489 | 12/1941 | Tiegler et al. | 248/152 |
| 2,301,216 | 11/1942 | Koontz | 248/152 |
| 2,727,645 | 12/1955 | Dore | 215/100.5 |
| 3,029,058 | 4/1962 | Himler | 248/310 |
| 3,964,709 | 6/1976 | LaBelle et al. | 248/311.2 |
| 4,312,465 | 1/1982 | Sinkhorn et al. | 224/36 |
| 4,596,370 | 6/1986 | Adkins | 248/311.2 |
| 4,795,117 | 1/1989 | Siteman | 248/910 |
| 4,993,611 | 2/1991 | Longo | 248/311.2 |
| 5,025,940 | 6/1991 | Akly | 215/100 |
| 5,141,188 | 8/1992 | DeBlasi et al. | 248/142 |
| 5,664,711 | 9/1997 | Mellon | 224/217 |

*Primary Examiner*—Ramon O. Ramirez
*Assistant Examiner*—Anita M. King
*Attorney, Agent, or Firm*—Herbert C. Schulze

[57] ABSTRACT

A method and apparatus for holding bottles, especially fingernail polish bottles, in such manner that tipping and spillage is virtually impossible, featuring a padded strap-like apparatus which can be laid flat on a surface or draped over an object in such manner that an attached bottle holder featuring a pierced and serrated diaphragm in which a bottle is placed will remain in alignment with the bottle upright at all times.

2 Claims, 1 Drawing Sheet

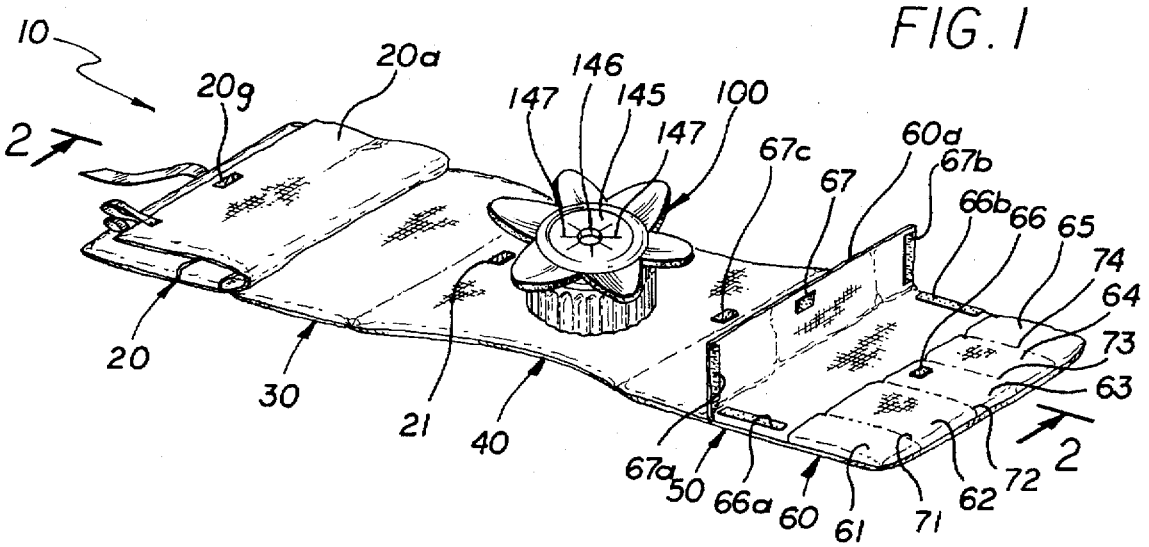
FIG. 1
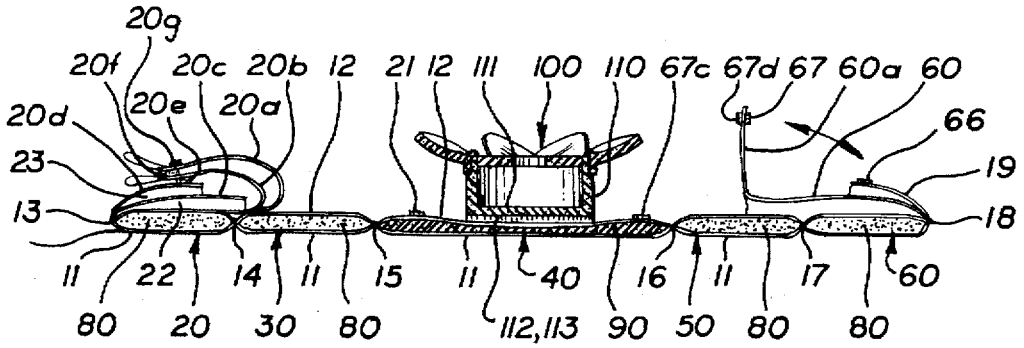
FIG. 2
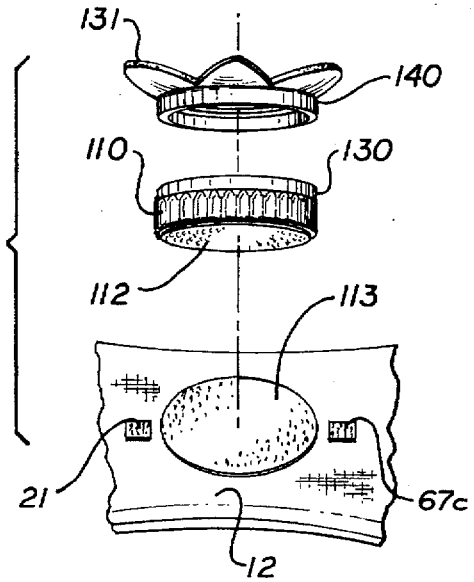
FIG. 3
FIG. 4
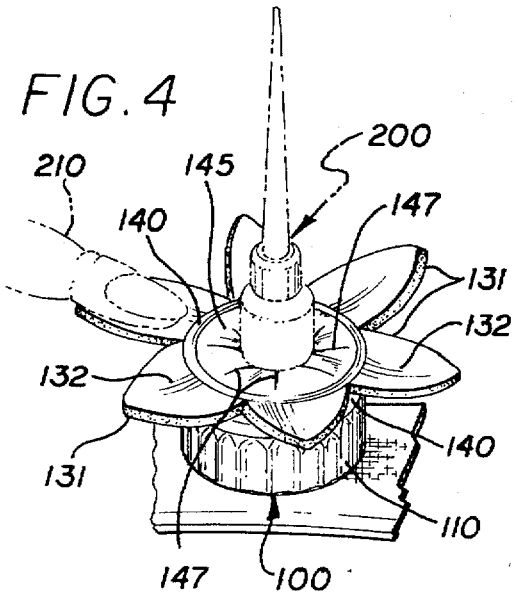

METHOD AND APPARATUS FOR HOLDING BOTTLES

CROSS REFERENCE TO RELATED APPLICATIONS

There are no patent applications filed by use related to the within application.

BACKGROUND OF THE INVENTION

I. Field of the Invention

This invention is in the general field of methods and apparatus for holding bottles and the like;

The invention is even more particularly in the field of holding nail polish bottles and the like;

The invention is even more particularly in the field of portable spill-proof holding of such bottles together with compartmented holding of accessories to be used with the contents of such bottles.

II. Description of the Prior Art

We are aware of holders of containers, or bottles, of beverages mounted within vehicles. We are also aware of some bottles, such as ink bottles, which have an enlarged bottom designed to prevent tipping when being used on a desk of the like.

We are not aware of any method or device utilizing the principles of our invention which provides for holding of bottles of nail polish and the like under virtually any conditions of usage without the necessity of using any particular piece of furniture or the like.

SUMMARY OF THE INVENTION

The use of fingernail polish is widespread. Many users of fingernail polish carry fingernail polish with them to apply touch up (or complete manicuring) while traveling (in public or private vehicles and the like), while engaged in an occupation or recreation (such as sunbathing) and the like.

A very common problem encountered by those who apply fingernail polish is properly holding the bottles so that they do not tip and spill the contents. There are other liquids in bottles or other containers which may share the same difficulty.

Another problem associated with the use of fingernail polish and the like is the proper placement of the fingernail on a surface while applying polish or doing other things involved in manicuring.

Still another difficulty which presents itself during manicuring or touch up work is maintaining instruments such as scissors, buffers, and the like in convenient and secure placement while not in actual use.

With the foregoing and other factors in mind, we have studied this overall situation. We have now conceived and developed a method and apparatus which virtually eliminates all of the problems and difficulties associated with the use of fingernail polish under varying conditions, especially when traveling and the like.

We have accomplished this by providing a spill resistant holder for fingernail polish bottles or the like which can be used on virtually any surface, together with means for properly and safely securing and using such holder where there is no suitable surface to be used. In this latter case, we have provided a flexible support for the bottle holder which can drape over a person's arm or leg or over an arm rest on a chair, the seat or back of a seat in a vehicle, or most any other condition.

Finally we have provided the flexible support with pockets to contain all necessary auxiliary items used in connection with manicuring or the like.

It is an object of this invention to provide a spill resistant support, or holder, for fingernail polish bottles or the like;

Another object of this invention is to provide such a support, or holder, which also carries auxiliary equipment and supplies to be used in connection with use of the contents of the bottles or the like.

The foregoing and other objects and advantages of this invention will become apparent to those skilled in the art upon reading the description of a preferred embodiment, which follows, in conjunction with a review of the appended drawings.

BRIEF DESCRIPTION OF THE DRAWINGS

FIG. 1 is a perspective of an apparatus suitable to practice the method of this invention;

FIG. 2 is a section on 2—2 of FIG. 1;

FIG. 3 is an exploded view of the holder element 100 and a fragment of the underlying support as shown in FIG. 1; and FIG. 4 illustrates the use of the device 100 to support a finger.

DESCRIPTION OF A PREFERRED EMBODIMENT

FIGS. 1 and 2 show an apparatus 10, which is an elongated flexible strap-like device comprising a multiplicity of pads 20, 30,40, 50, and 60. These pads are preferably formed of an upper length 12 and a lower length 11 of cloth, or the like, closed at ends 13 and 18 and along its sides. Five separate pads have been formed by sewing or the like at 14, 15, 16, and 17. Preferably, there will be a weighted filling material 80 such as sand, or the like, in the pads 20, 30, 50, and 60. Pad 40 will, preferably contain a sheet of foam or the like 90.

Pockets 22 and 23 for holding supplies such as cotton and the like are formed above pad 20 and across its width by sewing cloth or the like 20*c* and 20*d* at the end 13 and along the edges with openings as can be seen in FIG. 2. These pockets are closed by the double flaps 20*a* and 20*b*, which are closed together at 20*f* and can be held in place on material 20*d* at 20*e*. A closure material at 20*g* can fasten to closure material 21 to hold the flaps 20 a and 20*b* open when desired.

At the other end of the device cloth or the like 60 is sewed or otherwise fastened to the end 18. Another sheet of cloth or the like 19 is also fastened at the end 18 and along the edges over pad 60. Individual pockets 61, 62, 63, 64 and 65 for holding accessories such as scissors and the like are formed by sewing or the like at 71, 72, 73, and 74. Flap 60*a* can be closed over the accessory pockets by closure material 66, 66*a*, 66*b*, 67, 67*a*, and 67*b*. Flap 60*a* can be held in a completely open position by closure material 67*c* and 67*d*.

Reference has been made to "closure material". The preferred material for these purposes is hook and loop material, which is known to those skilled in the art. As known to those skilled in the art, such closure is accomplished by hook material on one element and loop (or felt) material on the other. Other means could be used for closing and opening the flaps indicated. For example buttons and button holes, snaps, or other materials could be used.

FIGS. 3 and 4 show in detail the basic spill resistant bottle holding apparatus, which is felt to be a sub-invention in itself. A cylindrical cup is shown. The cup has a closed bottom end 111. A flexible diaphragm 145 of rubber or other suitable material is affixed in the upper end of the cup. The diaphragm is pierced or has a hole 146 in the center with slits 147 to allow for a serrated-like holding of bottle 200 shown in phantom (the bottle is not part of the invention) in FIG. 4. A removable ring 140 carrying a number of petal shaped extensions 131 slips over the smooth exterior portion 130 of the cylindrical cup. The major portion of the exterior of the cup will be scalloped as at 110. The petal shaped extensions will be slightly cupped at 132 to allow for a finger 210 to be supported as shown in phantom (the finger is not a part of the invention, but the extensions are) in FIG. 4. When the finger is supported as shown in phantom it is easier to apply touch up polish. The bottom 11 of the cup is covered by a disc of the loop, or felt, material of a hook and loop type material. A disc 113 of hook material from a hook and loop combination is affixed to the top surface 12 of the elongated flexible strap-like device.

The bottle holding cup can be used separately on any surface and the petals may be removed if desired. Preferably, though, the petals should remain to give the maximum protection against spillage. The reason is that the cup cannot tip completely with the petals in place.

The elongated flexible strap-like device as shown and described is considered to be preferred and constitutes certain inventive features, it must be understood that another drapeable strap or the like could be used. Also, some or all of the pockets shown might be eliminated without departing from the broadest basic teaching of this invention.

While the embodiments of this invention shown and described are fully capable of achieving the objects and advantages desired, it is to be understood that these embodiments are for purposes of illustration only and not for purposes of limitation.

We claim:

1. A bottle holding apparatus comprising: a first weighted pad having a defined width, length, and thickness carrying at least one closeable pocket; a second weighted pad connected to said first weighted pad; a third pad connected to said second weighted pad and carrying attaching means suitable to attach to a removable bottle holding means; a bottle holding means removably attached to said attaching means; a fourth weighted pad attached to said third pad; and a fifth weighted pad carrying at least one implement pouch attached to said fourth pad.

2. The apparatus of claim 1 wherein the bottle holding means has finger support means depending outwardly therefrom.

* * * * *